US007675005B2

(12) United States Patent
Annavarapu et al.

(10) Patent No.: US 7,675,005 B2
(45) Date of Patent: Mar. 9, 2010

(54) CERAMIC IGNITER

(75) Inventors: Suresh Annavarapu, Somerville, MA (US); Thomas J. Sheridan, Oakham, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 259 days.

(21) Appl. No.: 11/261,421

(22) Filed: Oct. 28, 2005

(65) Prior Publication Data

US 2006/0131295 A1 Jun. 22, 2006

Related U.S. Application Data

(60) Provisional application No. 60/623,389, filed on Oct. 28, 2004.

(51) Int. Cl.
*F23Q 7/22* (2006.01)
*F23Q 7/00* (2006.01)

(52) U.S. Cl. ..... 219/270; 219/260

(58) Field of Classification Search ..... 219/270, 219/269, 268, 267, 266, 265, 264, 263, 262, 219/261, 260

See application file for complete search history.

(56) References Cited

U.S. PATENT DOCUMENTS 5,756,215 A 5/1998 Sawamura et al.
5,786,565 A * 7/1998 Willkens et al. ..... 219/260
5,801,361 A * 9/1998 Willkens et al. ..... 219/270
5,820,789 A 10/1998 Willkens et al.
5,856,651 A 1/1999 Shaffer
5,880,432 A 3/1999 Radmacher
5,892,201 A * 4/1999 Croucher et al. ..... 219/267
5,993,722 A 11/1999 Radmacher
6,002,107 A * 12/1999 Willkens et al. ..... 219/270
6,028,292 A * 2/2000 Willkens et al. ..... 219/270
6,040,519 A 3/2000 Kita et al.
6,084,212 A 7/2000 Leigh
6,130,410 A 10/2000 Kita et al.
6,184,497 B1 2/2001 Leigh
6,274,079 B1 8/2001 Lindemann et al.
6,278,087 B1 8/2001 Willkens et al.
6,297,183 B1 10/2001 Willkens et al.
6,309,589 B1 10/2001 Knoll et al.
6,320,167 B1 11/2001 Lindemann et al.
6,396,028 B1 5/2002 Radmacher
6,474,492 B1 11/2002 Willkens et al.
6,563,093 B2 5/2003 Lindemann et al.
6,582,629 B1 6/2003 Lin et al.
6,610,964 B2 8/2003 Radmacher
6,710,305 B2 3/2004 Lindemann et al.
6,727,473 B2 4/2004 Taniguchi et al.
6,744,016 B2 6/2004 Watanabe et al.
6,780,349 B1 8/2004 Lindemann et al.
6,881,930 B2 4/2005 Yoshikawa et al.
6,900,412 B2 5/2005 Taniguchi et al.

(Continued)

*Primary Examiner*—Daniel L Robinson
(74) *Attorney, Agent, or Firm*—Edwards Angell Palmer & Dodge LLP; Peter F. Corless; Lisa Swiszcz Hazzard

(57) ABSTRACT

New ceramic resistive igniter elements are provided that comprise a first conductive zone, a resistive hot zone, and a second conductive zone, all in electrical sequence. In preferred igniters, at least a substantial portion of the first conductive zone does not contact a ceramic insulator. Preferred igniters of the invention have a rounded cross-sectional shape for at least a portion of the igniter length.

33 Claims, 3 Drawing Sheets

U.S. PATENT DOCUMENTS 6,949,717 B2 * 9/2005 Haluschka et al. ..... 219/270
2004/0079745 A1 4/2004 Haluschka et al.
2005/0284859 A1 12/2005 Konishi

* cited by examiner

CERAMIC IGNITER

The present application claims the benefit of U.S. provisional application No. 60/623,389, filed Oct. 28, 2004, which is incorporated herein by reference in its entirety.

BACKGROUND

1. Field of the Invention

In one aspect, the invention provides new ceramic resistive igniter elements that comprise an inner first conductive zone, a resistive hot zone, and an outer second conductive zone, all in electrical sequence. In preferred igniters, at least a substantial portion of the first conductive zone does not contact a ceramic insulator. Preferred igniters of the invention are substantially rod-shaped (e.g. rounded cross-sectional shape such as substantially circular cross-sectional area) and can exhibit good mechanical integrity and time-to-temperature properties.

2. Background

Ceramic materials have enjoyed great success as igniters in e.g. gas-fired furnaces, stoves and clothes dryers. Ceramic igniter production includes constructing an electrical circuit through a ceramic component a portion of which is highly resistive and rises in temperature when electrified by a wire lead. See, for instance, U.S. Pat. Nos. 6,028,292; 5,801,361; 5,405,237; and 5,191,508.

Typical igniters have been generally rectangular-shaped elements with a highly resistive "hot zone" at the igniter tip with one or more conductive "cold zones" providing to the hot zone from the opposing igniter end. One currently available igniter, the Mini-Igniter, available from Norton Igniter Products of Milford, N.H., is designed for 12 volt through 120 volt applications and has a composition comprising aluminum nitride ("AlN"), molybdenum disilicide ("$MoSi_2$"), and silicon carbide ("SiC").

A variety of performance properties are required of ceramic igniter systems, including high speed or fast time-to-temperature (i.e. time to heat from room temperature to design temperature for ignition) and sufficient robustness to operate for extended periods without replacement. Many conventional igniters, however, do not consistently meet such requirements.

Spark ignition systems are an alternative approach to ceramic igniters. See, for instance, U.S. Pat. No. 5,911,572, for a particular spark igniter said to be useful for ignition of a gas cooking burner. One favorable performance property generally exhibited by a spark ignition is rapid ignition. That is, upon activation, a spark igniter can very rapidly ignite gas or other fuel source.

In certain applications, rapid ignition can be critical. For instance, so-called "instantaneous" water heaters are gaining increased popularity. See, generally, U.S. Pat. Nos. 6,167,845; 5,322,216; and 5,438,642. Rather than storing a fixed volume of heated water, these systems will heat water essentially immediately upon opening of a water line, e.g. a user turning a faucet to the open position. Thus, essentially immediate heating is required upon opening of the water to deliver heated water substantially simultaneously with the water being turned "on". Such instantaneous water heating systems have generally utilized spark igniters. At least many current ceramic igniters have provided too slow time-to-temperature performance for commercial use in extremely rapid ignition applications such as required with instantaneous water heaters.

Current ceramic igniters also have suffered from breakage during use, particularly in environments where impacts may be sustained such as igniters used for gas cooktops and the like.

It thus would be desirable to have new ignition systems. It would be particularly desirable to have new ceramic igniters with enhanced time-to-temperature properties. It also would be desirable to have new igniters that have good mechanical integrity.

SUMMARY OF THE INVENTION

We now provide ceramic igniters that include new configurations of regions of differing resistivity. Igniters of the invention can exhibit notable mechanical integrity as well as good ignition performance properties such as rapid time-to-ignition temperature values.

More particularly, new ceramic resistive igniter elements are provided that comprise a first conductive zone, a resistive hot zone, and a second conductive zone, all in electrical sequence. Thus, during use of the device electrical power can be applied to the first conductive zone through use of an electrical lead, but where an electrical lead does not provide power to the second conductive zone.

Preferably, at least a substantial portion of the first conductive zone does not contact a ceramic insulator. That absence of a ceramic insulator can promote rapid time-to-ignition temperature values for the igniter system.

In one aspect, preferred igniters of the invention of the invention have a rounded cross-sectional shape along at least a portion of the igniter length (e.g., the length extending from where an electrical lead is affixed to the igniter to a resistive hot zone). More particularly, preferred igniters may have a substantially oval, circular or other rounded cross-sectional shape for at least a portion of the igniter length, e.g. at least about 10 percent, 40 percent, 60 percent, 80 percent, 90 percent of the igniter length, or the entire igniter length. A substantially circular cross-sectional shape that provides a rod-shaped igniter element is particularly preferred.

The invention also provided igniters that have non-rounded or non-circular cross-sectional shapes for at least a portion of the igniter length.

Igniters of the invention may have a variety of configurations. In a preferred configuration, a conductive shaft element is positioned within a conductive tube element and both the shaft and tube elements mate with a hot zone cap or end region.

More particularly, preferred igniters also include those of a coaxial design, preferably where a first conductive zone extends within an encasing second conductive zone with a resistive (hot) zone positioned between the cross-sectionally overlapping conductive zones. In such configurations, the first and second conductive zones may be suitably segregated by an interposed ceramic insulator region that mates with one or both of the conductive zones. Alternatively and often preferred, an interposing void (air) region may segregate the two conductive zones. In such configurations, at least a portion of the a first conductive zone is encased by or otherwise nested within the second conductive zone, e.g. where up to about 10, 20, 30, 40, 50, 60, 70 80 or 90 percent of the first conductive zone length overlaps cross-sectionally with an outer conductive igniter region, such as igniter configurations exemplified in the drawings.

Ceramic igniters of the invention can be employed at a wide variety of nominal voltages, including nominal voltages of 6, 8, 10, 12, 24, 120, 220, 230 and 240 volts.

The igniters of the invention are useful for ignition in a variety of devices and heating systems. More particularly, heating systems are provided that comprise a sintered ceramic igniter element as described herein. Specific heating systems include gas cooking units, heating units for commercial and residential buildings, and various heating units that require extremely fast ignition such as instantaneous water heaters.

Other aspects of the invention are disclosed infra.

BRIEF DESCRIPTION OF THE DRAWINGS

FIG. 7B is a view taken along line 7B-7B of FIG. 7A; FIG. 8B is a view taken along line 8B-8B of FIG. 8A.

DETAILED DESCRIPTION OF THE INVENTION

As discussed above, ceramic igniter systems are provided that include new configurations of conductive (cold) and resistive (hot) regions.

Among other things, preferred igniters of the invention may exhibit rapid time-to-temperature values. As referred to herein, the term "time-to-temperature" or similar term refers to the time for an igniter hot zone to rise from room temperature (ca. 25° C.) to a fuel (e.g. gas) ignition temperature of about 1000° C. A time-to-temperature value for a particular igniter is suitably determined using a two-color infrared pyrometer. Particularly preferred igniters of the invention may exhibit time-to-temperature values of about 3 seconds or less, or even about 2 seconds or less.

Figure 1:
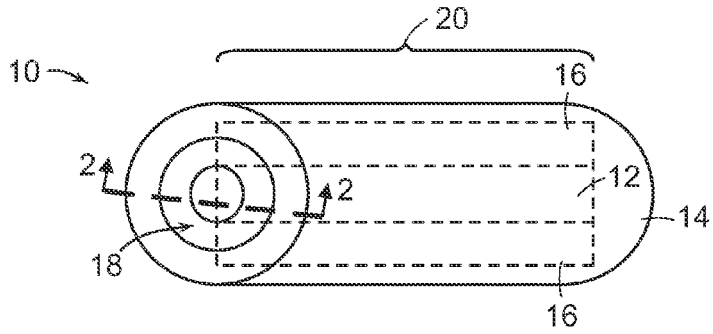
FIG. 1 shows a preferred igniter system of the invention in partial phantom view.

Referring now to the drawings, FIG. 1 shows a preferred igniter system 10 in partial phantom view where conductive core element 12 mates with a resistive hot zone 14 that in turn mates with second conductive zone 16 that forms the outer lower portion 20 of igniter 10.

Figure 2:
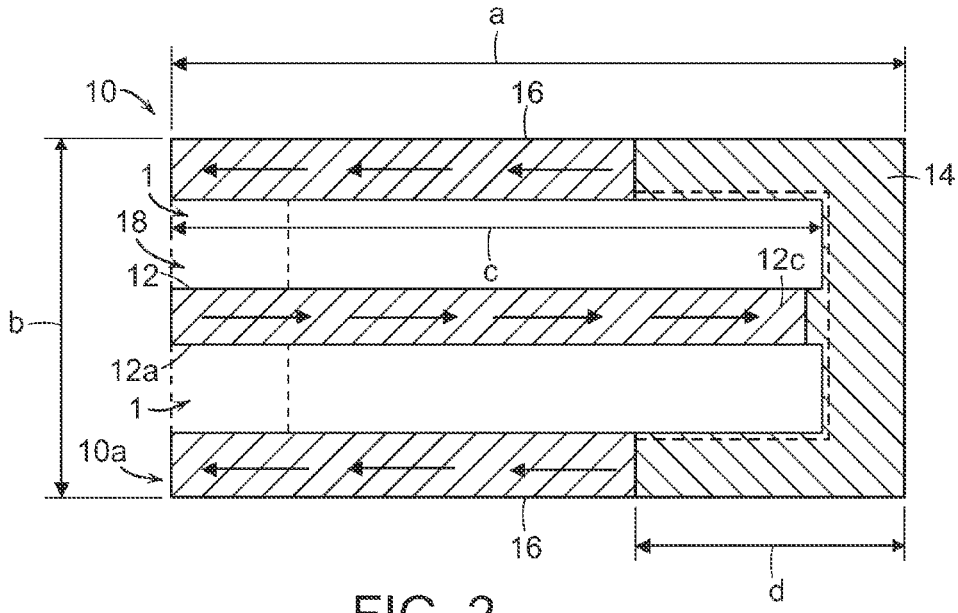
FIG. 2 shows a cut-away view along line 2-2 of FIG. 1.

That electrical path also can be clearly seen in FIG. 2 where electrical power enters the igniter system 10 through the interposed conductive core element 12 that mates with resistive hot zone 14. Proximal end 12*a* of conductive element 12 may be affixed such as through brazing to an electrical lead (not shown) that supplies power to the igniter during use. The igniter proximal end 10*a* suitably may be mounted within a variety of fixtures, such as where a ceramoplastic sealant material encases conductive element proximal end 12*a* as disclosed in U.S. Published Patent Application 2003/0080103.

As shown in FIG. 2, the igniter's 10 electrical path extends from conductive core element 12 through resistive hot zone 14 then through outer, encasing conductive region 16.

As can be seen in FIGS. 1 and 2, the first, inner conductive zone 12 is segregated through void region 18 from the other igniter areas until mating with hot zone 14 at the conductive zone distal portion 12*c*. Further, as discussed above, in preferred systems such as those depicted in FIGS. 1 and 2, the proximal portion 12*a* of the first conductive zone does not contact a ceramic heat sink (insulator) area that has been employed in certain prior systems. For at least many applications, suitably the igniter may not contain any insulator or heat sink region and will contain only two regions of the differing resistivity, i.e. the igniter will contain only conductive (cold) zone(s) and a higher resistivity (hot) zone.

As discussed above, such absence of a ceramic insulator from at least a substantial portion of the first conductive zone length can provide significant advantages, including enhanced time-to-temperature performance of the igniter. As referred to herein, "a substantial portion of the first conductive zone length" indicates that at least about 40 percent of the length of the conductive zone as measured from the point of affixation of an electrical lead to the mating hot zone (as shown by distance a is FIG. 2) does not contact a ceramic insulator material (for example, as shown by dashed lines in FIG. 2 depicting an embodiment provided with ceramic insulator material 1). More preferably, at least about 50, 60, 70, 80, 90 or 95 percent or the entire length of the conductive zone as measured from the point of affixation of an electrical lead to the mating hot zone (as shown by distance a is FIG. 2) does not contact a ceramic insulator material. In particularly preferred systems, at least a substantial portion of the first conductive zone length is exposed such as to void area 18 as generally depicted in the igniters exemplified in FIGS. 1 and 2.

As discussed above, and exemplified in FIG. 1, preferably, at least a substantial portion of the igniter length have a rounded cross-sectional shape along at least a portion of the igniter length, such as length a shown in FIG. 2. FIG. 1 depicts a particularly preferred configuration where igniter 10 has a substantially circular cross-sectional shape for about the entire length of the igniter to provide a rod-shaped igniter element. However, as discussed above, preferred systems also include those where only a portion of the igniter has a rounded cross-sectional shape, such as where up to about 10, 20, 30, 40, 50, 60, 70 80 or 90 percent of the igniter length (as exemplified by igniter length a in FIG. 2) has a rounded cross-sectional shape; in such designs, the balance of the igniter length may have a profile with exterior edges.

Figure 3:
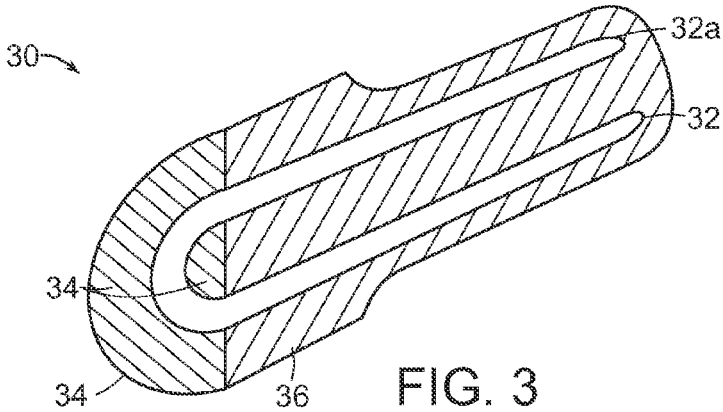
FIG. 3 shows a cut-away view of a further preferred igniter of the invention.

FIG. 3 depicts another preferred igniter 30 (in cut-away view) where interposed first conductive zone 32 extends from a proximal end 32*a* (which may have an affixed electrical lead as discussed above) and extends to resistive zone 34 and is encased within second conductive zone 36, with interposed void region 38.

Figure 4:
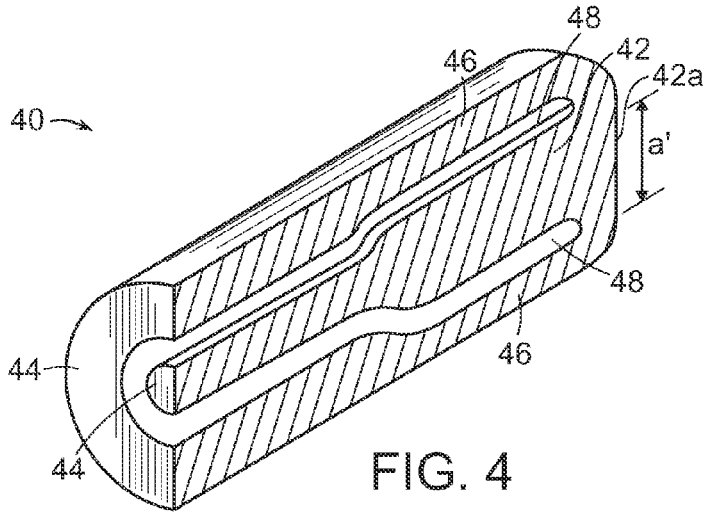
FIG. 4 shows a cut-away view of another preferred igniter of the invention.

FIG. 4 shows a further preferred igniter 40 (in cut-away view) where interposed first conductive zone 42 extends from a proximal end 42*a* (which may have an affixed electrical lead as discussed above) and extends to resistive hot zone 44 and is encased within second conductive zone 46, with void region 48 interposed between conductive zones 42 and 46. As shown in FIG. 4, first conductive zone 42 has a differing width a' over the igniter length and decreases toward the igniter resistive zone. Inner or first conductive zones of other varying widths also may be employed, e.g. where the a first conductive zone width is greater toward the igniter resistive hot zone relative to the first conductive zone width at the igniter proximal end.

Figure 5:
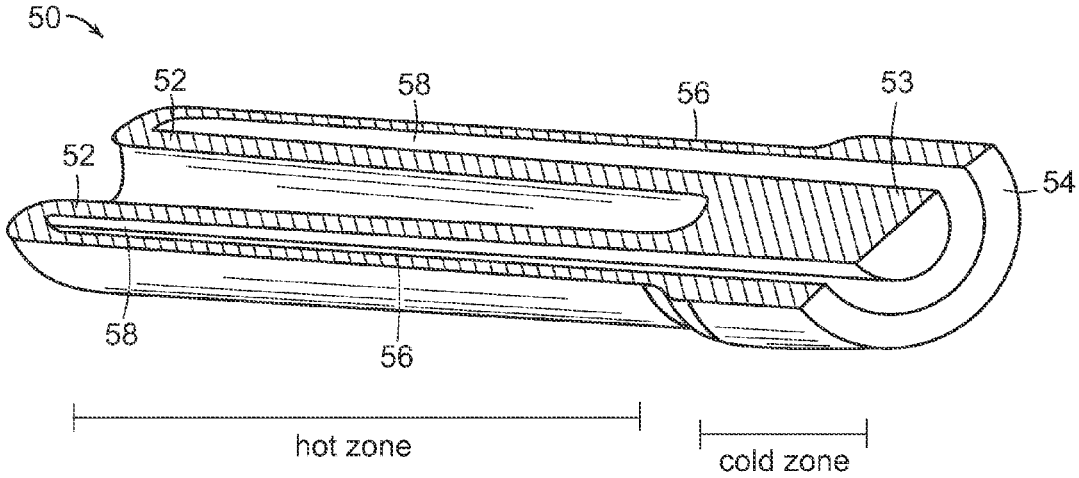
FIGS. 5 and 6 show further preferred igniters of the invention.

FIG. 5 shows another preferred igniter 50 of the invention in half view (cut-away view) that comprises an interposed first conductive zone 53 that mates with distal resistive hot zone 52 and is encased with second outer conductive zone 56. The first and second conductive zones are at least partially segregated by void 58. The electrical conductive path of the igniter extends from the first conductive zone 53 through the hot zone 52 through the encasing second conductive zone 56 and then through zone 54.

Figure 6:
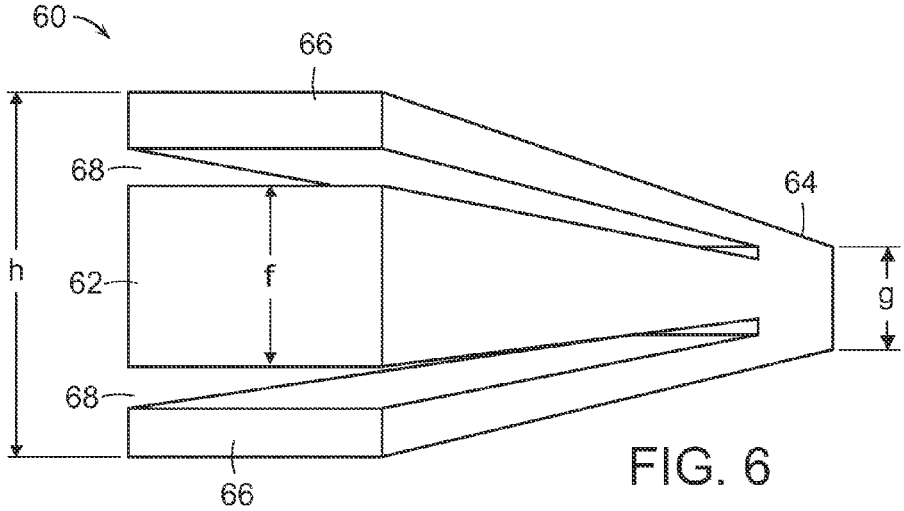

In FIG. 6, a further igniter system 60 of the invention is shown, where the igniter width or cross-sectional area is decreased at the distal resistive zone area relative to the igniter width or cross-sectional area in conductive zone areas. For example, a first conductive zone area 62 of an igniter may have a maximum cross-sectional area or width (width f in FIG. 6) that is at least 2, 3, 4, 5, 6, 7, 8, 9 or 10 times greater than a hot zone 64 minimum cross-sectional area or width (width g in FIG. 6).

Similarly, referring to FIG. 5, the maximum cross-sectional area of igniter 50 may be at least 2 times greater than a hot zone 52 minimum cross-sectional area, more preferably, a maximum igniter cross-sectional area that is at least 3, 4, 5, 6, 7, 8, 9 or 10 times greater than a hot zone 52 minimum cross-sectional area.

By such a decreasing width or cross-sectional area of a hot zone area, the differences in compositions used to form the conductive and hot zones can be minimized, which can provide advantages of enhanced mating of the distinct zones, including good matching of coefficients of thermal expansion of the compositions of the distinct zones, which can avoid cracking or other potential degradation of the igniter.

More particularly, such a decreasing width or cross-sectional area of a hot zone area can enable use of a ceramic composition in a hot zone area that is relatively conductive and at least approximates the ceramic material employed for conductive zones. In these systems, rather than the ceramic material itself, the decreased hot zone width provides resistive heating.

As discussed above, while a rounded cross-sectional shape is preferred for many application, preferred igniters of the invention also may have a non-rounded or non-circular cross-sectional shape for at least a portion of the igniter length, e.g. where up to or at least about 10, 20, 30, 40, 50, 60, 70 80 or 90 percent of the igniter length (as exemplified by igniter length a in FIG. 2) has a cross-sectional shape that is non-rounded or non-circular, or where the entire igniter length (as an igniter length is exemplified by length a in FIG. 2) has a cross-sectional shape that is non-rounded or non-circular.

Figure 7A:
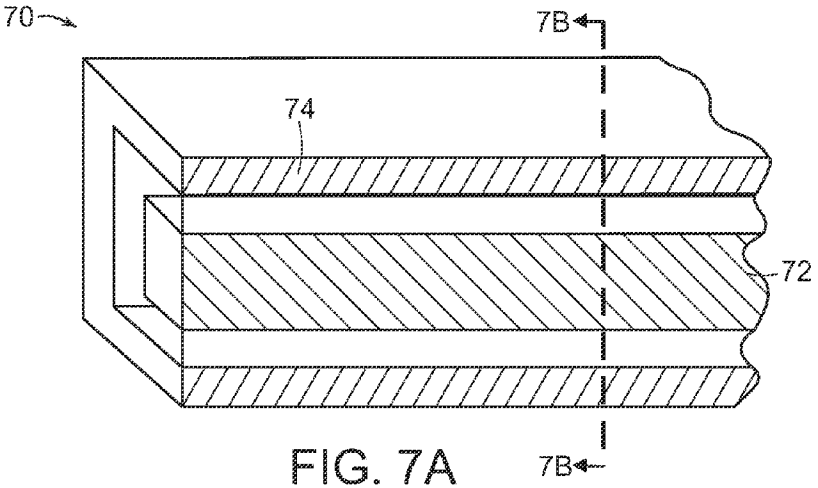
FIGS. 7A and 7B shows a further preferred igniter of the invention.
Figure 7B:
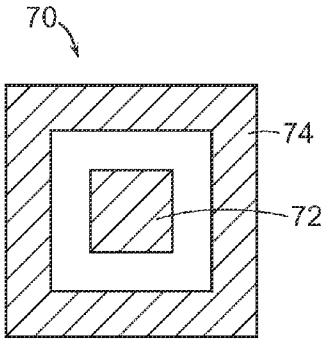

An igniter may be employed that has a substantially square (non-rounded) profile as exemplified by igniter element 70 depicted in FIGS. 7A and 7B. Igniter 70 comprises a rectangular-like or a stilt-like core conductive zone 72 with angular cross-sectional shape (more particularly, substantially square cross-sectional shape as clearly depicted in FIG. 7B) and similarly angular outer conductive zone 74 and hot zone (hot zone not shown in cut-away view of FIG. 7A).

Figure 8A:
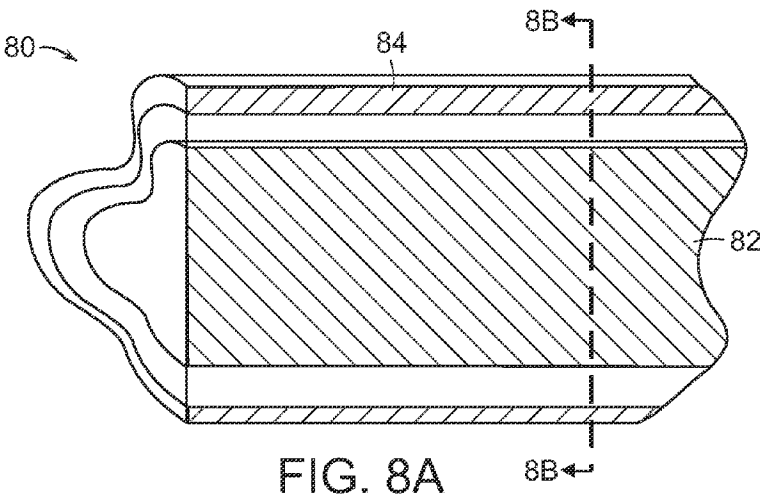
FIGS. 8A and 8B shows a further preferred igniter of the invention.
Figure 8B:
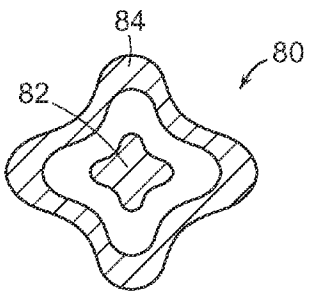

An igniter with an irregular rounded (non-circular) shaped profile also may be employed as exemplified by igniter element 80 as shown in FIGS. 8A and 8B. Igniter 80 comprises core conductive zone 82 and outer conductive zone 84 each having irregular rounded cross-sectional shapes.

Dimensions of igniters of the invention may vary widely and may be selected based on intended use of the igniter. For instance, the length of a preferred igniter (length a in FIG. 2) suitably may be from about 0.5 to about 5 cm, more preferably from about 1 about 3 cm, and the igniter cross-sectional width may suitably be from about (length b in FIG. 2) suitably may be from about 0.2 to about 3 cm.

Similarly, the lengths of the conductive and hot zone regions also may suitably vary. Preferably, the length first conductive zone (length c in FIG. 2) of an igniter of the configuration depicted in FIGS. 1 and 2 may be from 0.2 cm to 2, 3, 4, or 5 more cm. More typical lengths of the first conductive zone will be from about 0.5 to about 5 cm. The height of a hot zone (length din FIG. 2) may be from about 0.1 to about 2, 3, 4 or 5 cm, with a total hot zone electrical path length (shown as the dashed line in FIG. 2) of about 0.2 to 2 or more cm, with a total hot zone path length of about 1.5 or 2 cm generally preferred.

In preferred systems, the hot or resistive zone of an igniter of the invention will heat to a maximum temperature of less than about 1450° C. at nominal voltage; and a maximum temperature of less than about 1550° C. at high-end line voltages that are about 110 percent of nominal voltage; and a maximum temperature of less than about 1350° C. at low-end line voltages that are about 85 percent of nominal voltage.

A variety of compositions may be employed to form an igniter of the invention. Generally preferred hot zone compositions comprise at least three components of 1) conductive material; 2) semiconductive material; and 3) insulating material. Conductive (cold) and insulative (heat sink) regions may be comprised of the same components, but with the components present in differing proportions. Typical conductive materials include e.g. molybdenum disilicide, tungsten disilicide, nitrides such as titanium nitride, and carbides such as titanium carbide. Typical semiconductors include carbides such as silicon carbide (doped and undoped) and boron carbide. Typical insulating materials include metal oxides such as alumina or a nitride such as AIN and/or $Si_3N_4$.

As referred to herein, the term electrically insulating material indicates a material having a room temperature resistivity of at least about $10^{10}$ ohms-cm. The electrically insulating material component of igniters of the invention may be comprised solely or primarily of one or more metal nitrides and/or metal oxides, or alternatively, the insulating component may contain materials in addition to the metal oxide(s) or metal nitride(s). For instance, the insulating material component may additionally contain a nitride such as aluminum nitride (AIN), silicon nitride, or boron nitride; a rare earth oxide (e.g. yttria); or a rare earth oxynitride. A preferred added material of the insulating component is aluminum nitride (AIN).

As referred to herein, a semiconductor ceramic (or "semiconductor") is a ceramic having a room temperature resistivity of between about 10 and $10^8$ ohm-cm. If the semiconductive component is present as more than about 45 v/o of a hot zone composition (when the conductive ceramic is in the range of about 6-10 v/o), the resultant composition becomes too conductive for high voltage applications (due to lack of insulator). Conversely, if the semiconductor material is present as less than about 10 v/o (when the conductive ceramic is in the range of about 6-10 v/o), the resultant composition becomes too resistive (due to too much insulator). Again, at higher levels of conductor, more resistive mixes of the insulator and semiconductor fractions are needed to achieve the desired voltage. Typically, the semiconductor is a carbide from the group consisting of silicon carbide (doped and undoped), and boron carbide. Silicon carbide is generally preferred.

As referred to herein, a conductive material is one which has a room temperature resistivity of less than about $10^{-2}$ ohm-cm. If the conductive component is present in an amount of more than 35 v/o of the hot zone composition, the resultant ceramic of the hot zone composition, the resultant ceramic can become too conductive. Typically, the conductor is selected from the group consisting of molybdenum disilicide, tungsten disilicide, and nitrides such as titanium nitride, and carbides such as titanium carbide. Molybdenum disilicide is generally preferred.

In general, preferred hot (resistive) zone compositions include (a) between about 50 and about 80 v/o of an electrically insulating material having a resistivity of at least about $10^{10}$ ohm-cm; (b) between about 5 and about 45 v/o of a semiconductive material having a resistivity of between about 10 and about $10^8$ ohm-cm; and (c) between about 5 and about 35 v/o of a metallic conductor having a resistivity of less than about $10^{-2}$ ohm-cm. Preferably, the hot zone comprises 50-70 v/o electrically insulating ceramic, 10-45 v/o of the semiconductive ceramic, and 6-16 v/o of the conductive material. A specifically preferred hot zone composition for use in igniters of the invention contains 10 v/o $MoSi_2$, 20 v/o SiC and balance AlN or $Al_2O_3$.

As discussed, igniters of the invention contain a relatively low resistivity cold zone region in electrical connection with the hot (resistive) zone and which allows for attachment of wire leads to the igniter. Preferred cold zone regions include those that are comprised of e.g. AlN and/or $Al_2O_3$ or other insulating material; SiC or other semiconductor material; and $MoSi_2$ or other conductive material. However, cold zone regions will have a significantly higher percentage of the conductive and semiconductive materials (e.g., SiC and $MoSi_2$) than the hot zone. A preferred cold zone composition comprises about 15 to 65 v/o aluminum oxide, aluminum nitride or other insulator material; and about 20 to 70 v/o $MoSi_2$ and SiC or other conductive and semiconductive material in a volume ratio of from about 1:1 to about 1:3. For many applications, more preferably, the cold zone comprises about 15 to 50 v/o AlN and/or $Al_2O_3$, 15 to 30 v/o SiC and 30 to 70 v/o $MoSi_2$. For ease of manufacture, preferably the cold zone composition is formed of the same materials as the hot zone composition, with the relative amounts of semiconductive and conductive materials being greater.

A specifically preferred cold zone composition for use in igniters of the invention contains 20 to 35 v/o $MoSi_2$, 45 to 60 v/o SiC and balance either AlN and/or $Al_2O_3$.

At least certain applications, igniters of the invention may suitably comprise a non-conductive (insulator or heat sink) region, although particularly preferred igniters of the invention do not have a ceramic insulator insular that contacts at least a substantial portion of the length of a first conductive zone, as discussed above.

If employed, such a heat sink zone may mate with a conductive zone or a hot zone, or both. Preferably, a sintered insulator region has a resistivity of at least about $10^{14}$ ohm-cm at room temperature and a resistivity of at least $10^4$ ohm-cm at operational temperatures and has a strength of at least 150 MPa. Preferably, an insulator region has a resistivity at operational (ignition) temperatures that is at least 2 orders of magnitude greater than the resistivity of the hot zone region. Suitable insulator compositions comprise at least about 90 v/o of one or more aluminum nitride, alumina and boron nitride. A specifically preferred insulator composition of an igniter of the invention consists of 60 v/o AlN; 10 v/o $Al_2O_3$; and balance SiC. Another preferred heat composition for use with an igniter of the invention contains 80 v/o AlN and 20 v/o SiC.

The processing of the ceramic component (i.e. green body and sintering conditions) and the preparation of the igniter from the densified ceramic can be done by conventional methods and as discussed above. Typically, such methods are carried out in substantial accordance with methods disclosed in U.S. Pat. No. 5,786,565 to Wilkens and U.S. Pat. No. 5,191,508 to Axelson et al.

Briefly, two separate sintering procedures can be employed, a first warm press, followed by a second high temperature sintering (e.g. 1800 or 1850° C.). The first sintering provides a densification of about 55 to 70% relative to theoretical density, and the second higher temperature sintering provides a final densification of greater than 99% relative to theoretical density.

Once a dense ceramic igniter body is formed, void regions (such as region 18 shown in FIGS. 1 and 2) may be formed by machine-drilling. A suitable fabrication method is described in Example 1 below.

The igniters of the present invention may be used in many applications, including gas phase fuel ignition applications such as furnaces and cooking appliances, baseboard heaters, boilers, and stove tops. In particular, an igniter of the invention may be used as an ignition source for stove top gas burners as well as gas furnaces.

As discussed above, igniters of the invention will be particularly useful where rapid ignition is beneficial or required, such as in ignition of a heating fuel (gas) for an instantaneous water heater and the like.

Igniters of the invention also are particularly suitable for use for ignition where liquid fuels (e.g. kerosene, gasoline) are evaporated and ignited, e.g. in vehicle (e.g. car) heaters that provide advance heating of the vehicle.

Preferred igniters of the invention are distinct from heating elements known as glow plugs. Among other things, frequently employed glow plugs often heat to relatively lower temperatures e.g. a maximum temperature of about 800° C., 900° C. or 1000° C. and thereby heat a volume of air rather than provide direct ignition of fuel, whereas preferred igniters of the invention can provide maximum higher temperatures such as at least about 1200° C., 1300° C. or 1400° C. to provide direct ignition of fuel. Preferred igniters of the invention also need not include gas-tight sealing around the element or at least a portion thereof to provide a gas combustion chamber, as typically employed with a glow plug system. Still further, many preferred igniters of the invention are useful at relatively high line voltages, e.g. a line voltage in excess of 24 volts, such as 60 volts or more or 120 volts or more including 220, 230 and 240 volts, whereas glow plugs are typically employed only at voltages of from 12 to 24 volts.

The following non-limiting examples are illustrative of the invention. All documents mentioned herein are incorporated herein by reference in their entirety.

EXAMPLE 1

Igniter Fabrication

Igniters of the invention may be prepared as follows. Hot zone and cold zone compositions are prepared for a first igniter. The hot zone composition comprises 70.8 volume % (based on total hot zone composition) $Al_2O_3$, 20 volume % (based on total hot zone composition) SiC, and 9.2 volume % (based on total hot zone composition) $MoSi_2$. The cold zone composition comprises 20 volume % (based on total cold zone composition) $MoSi_2$, 20 volume % (based on total cold zone composition) SiC, and 60 volume % (based on total cold zone composition) $Al_2O_3$. The cold zone composition is loaded into a hot die press die and the hot zone composition loaded on top of the cold zone composition in the same die.

The combination of compositions is densified together under heat and pressure to provide a solid bilayer block. A cylinder 0.25 inches in diameter was machined out from the block having a hot zone cap region mating with conductive bottom portion. The igniter was then machine-drilled to provide a removed channel from the conductive regions as generally depicted by voids 18 in FIGS. 1 and 2.

An igniter prepared by that machine-drilled procedure was energized at 50 volts and provided a resistive zone temperature of 1073° C. The same igniter was energized at 40 volts and provided a temperature of 942° C.

The invention has been described in detail with reference to particular embodiments thereof. However, it will be appreciated that those skilled in the art, upon consideration of this disclosure, may make modification and improvements within the spirit and scope of the invention.

What is claimed is:

1. A ceramic igniter having a rounded cross-sectional shape for at least a portion of the igniter length, the igniter comprising:

in electrical sequence, a first conductive zone, a resistive hot zone, and a second conductive zone, a void region interposed between the first and second conductive zones along at least a substantial portion of the lengths of first and second conductive zones, wherein at least a substantial portion of the first conductive zone length does not contact a ceramic insulator and the igniter has a rounded cross-sectional shape for at least a portion of the igniter length.

2. The ceramic igniter of claim 1 wherein the igniter has a substantially constant width for at least a substantial portion of the igniter length.

3. The ceramic igniter of claim 1 wherein the igniter width in a region comprising the first and second conductive zones is greater than the igniter width in a region comprising the hot zone.

4. The ceramic igniter of claim 3 wherein the igniter width in the conductive zones region is at least about three times greater than the igniter width in a the hot zone region.

5. The ceramic igniter of claim 1 wherein the first conductive zone is at least partially encased within the second conductive zone.

6. The ceramic igniter of claim 1 wherein the igniter has a substantially circular cross-sectional shape.

7. The ceramic igniter of claim 1 wherein the first conductive zone and second conductive zone mate with opposing ends of the hot zone.

8. The ceramic igniter of claim 1 wherein the igniter electrical pathway extends in sequence through the first conductive zone, the hot zone, and the second conductive zone.

9. The ceramic igniter of claim 1 wherein the igniter does not contain a ceramic insulator region.

10. A ceramic igniter comprising:

in electrical sequence, a first conductive zone, a resistive hot zone, and a second conductive zone, wherein the second conductive zone substantially encases the first conductive zone, wherein at least a substantial portion of the first conductive zone length does not contact a ceramic insulator, and the igniter has a rounded cross-sectional shape for at least a portion of the igniter length.

11. The ceramic igniter of claim 10 wherein a void region is interposed between at least a portion of the lengths of the first and conductive zones.

12. The igniter of claim 1 wherein the igniter has a substantially circular cross-sectional shape for at least about 40 percent of the igniter length.

13. The igniter of claim 1 wherein the igniter has a substantially circular cross-sectional shape for at least about 60 percent of the igniter length.

14. The igniter of claim 1 wherein the igniter has a substantially circular cross-sectional shape for at least about 90 percent of the igniter length.

15. The igniter of claim 10 wherein the igniter has a substantially circular cross-sectional shape for the entire igniter length.

16. The igniter of claim 10 wherein the igniter has a substantially circular cross-sectional shape for at least about 40 percent of the igniter length.

17. The igniter of claim 10 wherein the igniter has a substantially circular cross-sectional shape for at least about 60 percent of the igniter length.

18. The igniter of claim 10 wherein the igniter has a substantially circular cross-sectional shape for at least about 90 percent of the igniter length.

19. The igniter of claim 10 wherein the igniter has a substantially circular cross-sectional shape for the entire igniter length.

20. The igniter of claim 1 wherein the substantial portion is at least about 60%.

21. The igniter of claim 1 wherein the substantial portion at least 70%.

22. The igniter of claim 1 wherein the substantial portion is at least 80%.

23. The igniter of claim 1 wherein the substantial portion at least 90%.

24. A ceramic igniter comprising:

in electrical sequence, a first conductive zone, a resistive hot zone, and a second conductive zone, the second conductive zone substantially encasing the first conductive zone, a void region interposed between the first and second conductive zones along at least a substantial portion of the lengths of first and second conductive zones, wherein at least a substantial portion of the first conductive zone length does not contact a ceramic insulator.

25. The igniter of claim 24 wherein the igniter has a substantially circular cross-sectional shape for at least about 40 percent of the igniter length.

26. The igniter of claim 24 wherein the igniter has a substantially circular cross-sectional shape for at least about 60 percent of the igniter length.

27. The igniter of claim 24 wherein the igniter has a substantially circular cross-sectional shape for at least about 90 percent of the igniter length.

28. The igniter of claim 24 wherein the igniter has a substantially circular cross-sectional shape for the entire igniter length.

29. The igniter of claim 24 wherein the substantial portion is at least 60%.

30. The igniter of claim 24 wherein the substantial portion is at least 70%.

31. The igniter of claim 24 wherein the substantial portion is at least 80%.

32. The igniter of claim 24 wherein the substantial portion is at least 90%.

33. The igniter of claim 24 wherein the igniter is adapted for use with line voltages in excess of 24 volts.

* * * * *